US005557905A

United States Patent [19]

Harding

[11] Patent Number: 5,557,905

[45] Date of Patent: Sep. 24, 1996

[54] BIT FOR ADMINISTERING ANIMAL MEDICATION

[76] Inventor: Kay J. Harding, 6154 Bellfountain Rd., Corvallis, Oreg. 97333

[21] Appl. No.: 382,061

[22] Filed: Jan. 31, 1995

[51] Int. Cl.[6] ..... B68B 1/06

[52] U.S. Cl. ..... 54/7; 119/833

[58] Field of Search ..... 54/7, 8; 119/833; 604/38, 62, 79

[56] References Cited

U.S. PATENT DOCUMENTS

| | | | |
|---|---|---|---|
| 1,121,435 | 12/1914 | White | 604/79 |
| 1,146,479 | 7/1915 | De Vries | 604/79 |
| 2,754,822 | 7/1956 | Emelock | 128/264 |
| 3,238,941 | 3/1966 | Klein et al. | 128/264 |
| 3,424,158 | 1/1969 | Silver | 128/260 |
| 3,506,008 | 4/1970 | Huck | 128/261 |
| 3,757,781 | 9/1973 | Smart | 128/223 |
| 3,780,735 | 12/1973 | Crouter et al. | 128/223 |
| 3,934,584 | 1/1976 | Corio | 128/223 |
| 4,040,422 | 9/1977 | Kuhn | 604/79 |
| 4,060,083 | 11/1977 | Hanson | 128/223 |
| 4,063,404 | 12/1977 | Taylor | 54/8 |
| 4,637,816 | 1/1987 | Mann | 604/62 |
| 4,645,488 | 2/1987 | Matukas | 604/59 |
| 5,116,314 | 5/1992 | Inabinet | 604/77 |

FOREIGN PATENT DOCUMENTS

| | | | |
|---|---|---|---|
| 2404007 | 8/1975 | Germany | 54/8 |
| 92/06651 | 4/1992 | WIPO . | |

*Primary Examiner*—Robert P. Swiatek
*Assistant Examiner*—Elizabeth Shaw
*Attorney, Agent, or Firm*—William D. Haffner

[57] ABSTRACT

A hollow syringe type medicine applicator in the form of a bar bit wherein the device is placed and affixed in an equine patient's mouth for the purpose of dispensing treatment substances through an aperture of the bit directly onto the surface of the horse's tongue when a plunger is depressed.

12 Claims, 2 Drawing Sheets

BIT FOR ADMINISTERING ANIMAL MEDICATION

This invention relates generally to devices for administering medication to animals. More specifically, it relates to delivering safe and efficient doses of oral medication to horses, ponies, and mules.

BACKGROUND OF THE INVENTION

1. Description of the Prior Art

The treatment of internal parasite infestation in horses has historically been executed by delivering medicines into the animal's digestive tract. Some typical methods of delivering these medicines are listed below:

a. In earliest times, treatment consisted of a fluid "drench" administered to the back of the animal's throat, with hopes of the intended dose avoiding the air passages, and reaching the animal's gut.

b. Veterinary science developed the procedure of using a long, flexible nasal-gastric tube that is inserted into the nostril of the horse, and with practiced skill, avoids the air passages to the lung, then delivers the fluid medicated formula directly into the stomach with a pump.

c. In the ensuing years, commercial medicated food pellets were developed as a less traumatic method for delivery of treatment formulas to horses.

d. In more recent times, commercial anti-parasitic formulas have been perfected for use by the horse owner at home, bypassing the required assistance of a veterinarian. These preparations have been supplied in a paste form, which are administered by a hand-held syringe applicator. This syringe is inserted into the mouth of a horse and thumb pressure on the plunger expresses the medication into the animal's oral cavity.

2. Deficiencies of the Prior Art

Each above-described treatment has its limitations. These limitations are described in the similarly enumerated paragraphs below:

a. Direct drench methods into the mouth of horses is successful with only a small number of the most cooperative and quiet animals and an experienced handler. A guaranteed full safe dose is rarely possible, as well as difficult to achieve. Failure to deliver liquids safely past air passages can result in fluid entering the animal's lungs, and possible pneumonia or death b. The need for an experienced veterinarian to administer nasal-gastric tube drenches into the stomach of the horse is expensive, time consuming, and can cause the horse to become sensitized to unpleasant handling around the head. It does, however, assure a fully delivered dose.

c. Medicated food pellets are not acceptable to a large percentage of horses because of their aversion to chemical odors. Due to spillage, a full dose is not assured, even to the animal that accepts this form of medication.

d. Although an improvement over prior methods, the deficiencies of commercial hand-held syringe treatments are several. In shy or nervous horses, insertion into the mouth of a hand-held applicator can cause the horse to lift its head above the owner's arm reach; therefore, avoiding treatment. Some animals may back away in resistance or become panicky. This can lead to the bad habit of head shyness and form a vice. Even if a calm animal cooperatively accepts this applicator, an expressed dose of paste medication may be spit out partially as a blob. If the owner does not clear the horse's mouth of chewed hay, grass, or other food matter retained next to the teeth, a medicated dose can be ejected onto the ground with a food wad. Each loss of medication increases the treatment cost. In the instance of a novice or nervous and timid owner, the hand-held applicator system can lead to failure of treatment, intimidation by a nervous or resistant animal, or even physical injury to the owner.

SUMMARY OF THE INVENTION

According to the present invention, a device for delivery of oral medicines to horses, ponies, and mules consists of a syringe to deliver measured dosages with a hollow cylindrical tube which is fit into the horse's mouth as a bit. This tube may be attached by twine to the horse's headstall in order to keep the bit in place in the animal's mouth, therefore freeing the owner's hands. The smooth-surfaced tube lies comfortably in the animal's mouth by resting against the tongue. Pressure on the syringe's plunger causes a discharge of a measured oral preparation through an orifice in the mouthpiece of the bit, depositing the medicine directly onto the horse's tongue surface, thereby causing tongue movement and natural swallowing of the medicine, avoiding any spitting out of the measured dosage.

OBJECTS AND ADVANTAGES OF THE PRESENT INVENTION

A main object of this invention is to provide a simple system for delivery of oral treatment substances to equine patients with a tool constructed and operational in a manner that delivers the oral preparations with a minimum of stress for the patients and maximum safety for handlers.

Other objects of this invention are:

a. To provide an efficient dosing device for medicines whereby waste and spillage are avoided. Treatment substances are dispensed directly onto the surface of the animal's tongue, causing tongue movement which promotes natural direct swallowing; therefore, preventing loss of measure dosages.

b. To provide an improved method for gradual low-stress administration of oral substances with a minimum of unpleasantness.

c. To provide a device which is stationary in the patient's mouth, thus freeing the hands of the owner and allowing adequate time for necessary relaxation in apprehensive animals.

d. To provide a device that establishes and maintains an independent position in the animal's mouth; therefore, avoiding unnecessary or erratic hand motion directed towards the face of nervous or excitable animals.

e. To provide a device that maintains a passive position in the mouth of the animal which inspires relaxation and calmness.

f. To provide a simple system with ease of handling that enables success for the novice as well as for professionals.

g. To provide a medicating device that can be produced with various materials, either permanent or recyclable.

h. To provide the option of producing the device from materials such as flavored and/or colored plastic formulas for various commercial uses and product identification.

i. To provide the option of producing the device from materials such as stainless steel for long term service.

j. To provide a device that may be readily dismantled for cleaning and/or sterilizing.

k. To provide a medicine administering device that conforms to conventional modes of manufacture, is of simple construction, and easy to use, thereby providing a device that is economically feasible, durable, and relatively trouble free.

The subject matter of the present invention is particularly pointed out and distinctly claimed in the following description. The invention, however, both as to organization and method of operation together with further advantages and objects thereof may be best understood by reference to the following description taken in conjunction with the accompanying drawings wherein like reference numerals refer to like elements. It is to be understood that this embodiment of the present invention is not meant to be exhausting nor limiting but is for the purpose of illustration in order that others skilled in the art of manufacturing may fully understand the invention and principles thereof and the manner of applying it in a particular use so that they may modify it in various ways, each as may best be suited to the conditions of the particular use.

DESCRIPTION OF THE PREFERRED EMBODIMENT

Figure 1:
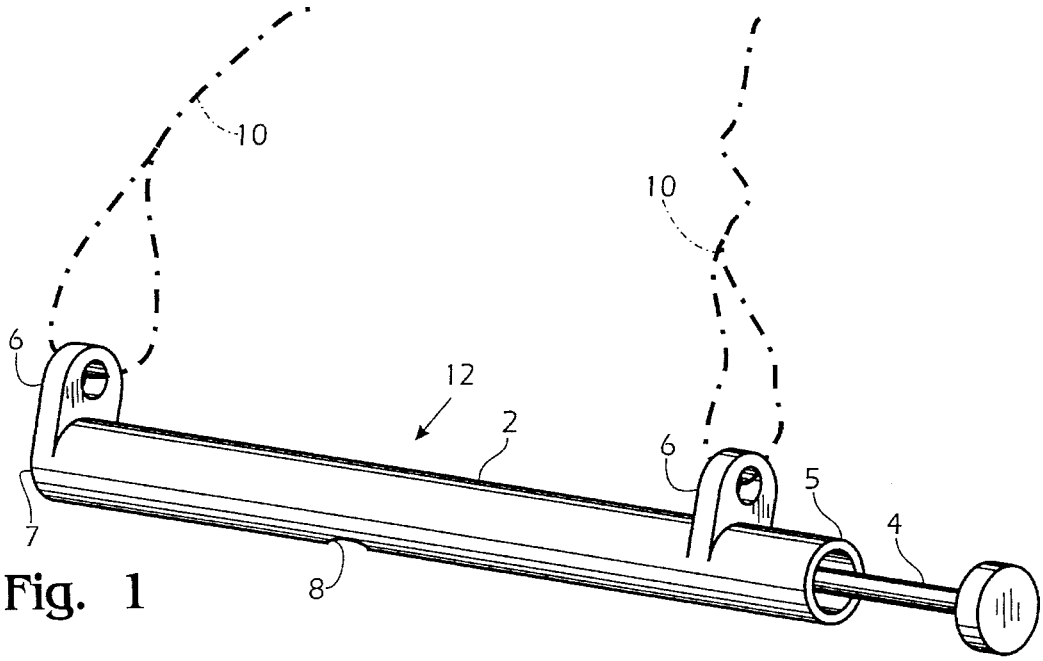
FIG. 1 illustrates a perspective view of the medication dispensing device of the present invention.
Figure 2:
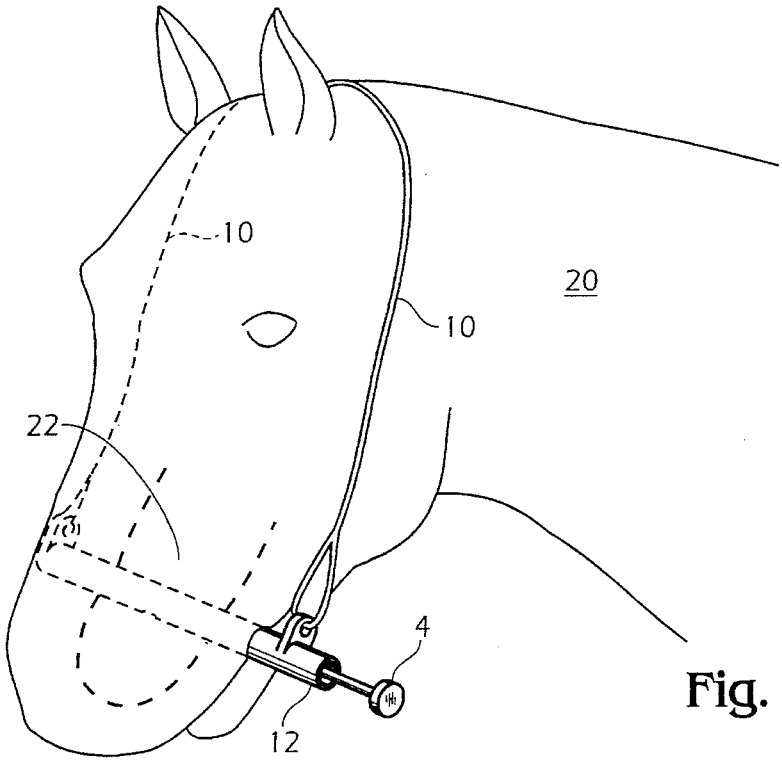
FIG. 2 illustrates how the medication dispensing device is used as a bar bit in the mouth of a horse.
Figure 3:
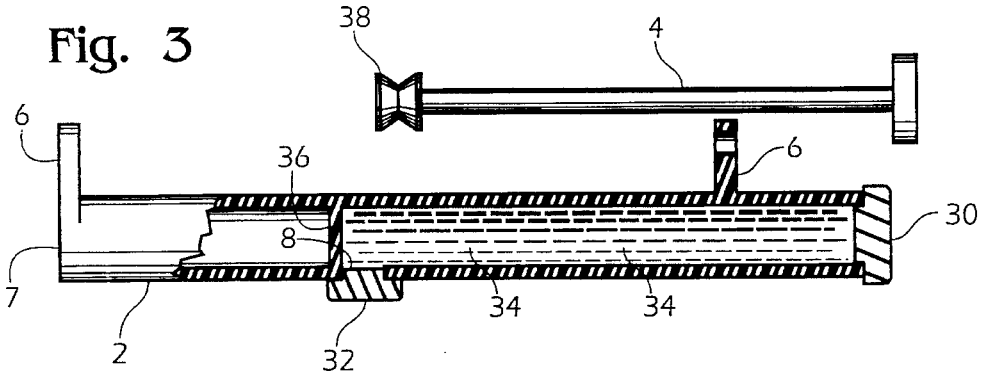
FIG. 3 illustrates a cross section of the medication dispensing device in its storage configuration.
Figure 4:
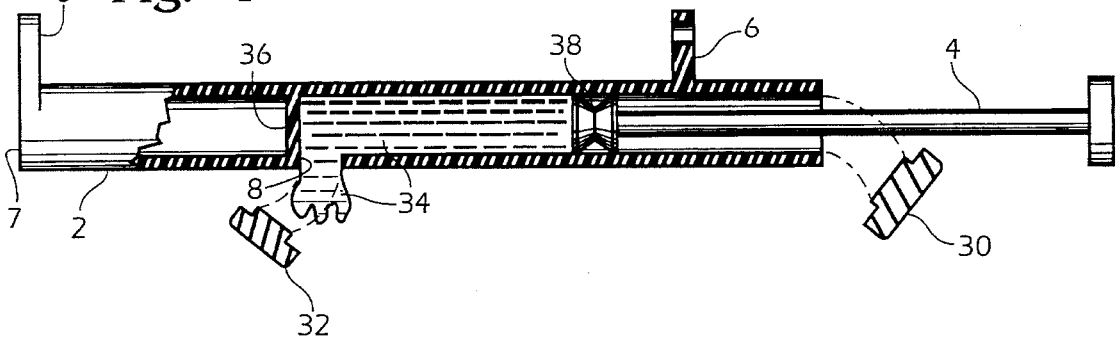
FIG. 4 illustrates a cross section of the medication dispensing device at the beginning of its operating cycle.
Figure 5:
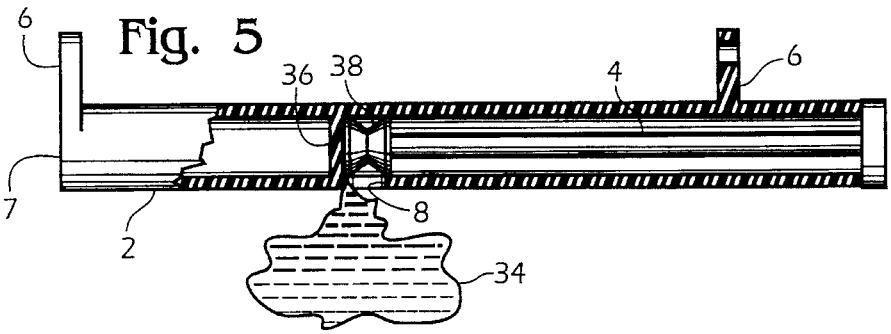
FIG. 5 illustrates a cross section of the medication dispensing device at the end of its operating cycle.

Referring to the drawings, medicine dispensing device 12 includes a hollow cylindrical tube 2 constructed of various suitable materials such as a firm recyclable plastic, nylon, or stainless steel. Optionally, the plastic material for tube 2 may be colored to denote different medicine formulations or flavored or perfumed to make medication dispensing device 12 more agreeable to the horse. Furthermore, tube 2 can be manufactured in various diameters in order to deliver different doses of medicine. Tube 2 has an opening at proximal end 5 for receiving paste medication 34. Tube 2 also has a dispensing orifice 8 located immediately in front of the proximal end of an internal stop wall 36. Tube 2 may be hollow from the stop wall to distal end 7 or stop wall 36 may be a solid cylinder to distal end 7. Orifice cap 32 and end cap 30 are provided to seal orifice 8 and proximal end 5, respectively, of tube 2. Caps 30 and 32 are for use when medicine dispensing device 12 is in storage.

In the preferred embodiment shown in FIG. 1, attachment means 6 consists of tabs with perforations for receiving attachment material 10. Other suitable attachment means are, for example:

a. a single perforation at the distal end of tube 2;

b. a single tab at either the distal end or proximal end of tube 2;

c. an integrally molded loop at the distal, proximal, or both ends of tube 2;

d. perforated discs at the distal, proximal, or both ends of tube 2;

e. a molded ring at the distal end of tube 2;

f. a molded ring at the distal end of tube 2 and molded ridges at the proximal end of tube 2 for retaining attachment material 10; and g. two orifices in opposite sides of the distal wall of tube 2 for passing attachment means 10 therethrough.

Twine or any suitable alternate attachment material 10 is used in conjunction with attachment means 6 to affix medicine dispensing device 12 to the horse's headstall and, thereby stabilizing the device in the horse's mouth in preparation for medicine dispensing.

Plunger 4 is constructed in the form of a rod. Plunger 4 can be constructed from any suitable material similar to tube 2. Optionally, plunger can be marked with gradations to meter the dispensing of medicine. Plunger tip 38 is constructed from silicone, rubber, plastic, or a similarly compressible material in order to form a tight seal within tube 2.

During operation, caps 30 and 32 are removed from medicine dispensing device 12 and plunger 4 is slidably inserted into tube 2. Medicine dispensing device 12 is then inserted into the mouth of horse 20 and attached to the horse's headstall with twine 10. When force is applied horizontally to plunger 4, it slides within tube 2, thereby causing paste medication 34 to pass through aperture 8 onto tongue 22 of horse 20. The medicine is completely discharged when plunger tip 38 contacts stop wall 38. With the discharge of medicine, horse 20 moves its tongue 22, promoting dissemination of paste medication 34, and swallows the dose.

This manner of delivery avoids wasteful spillage or spitting problems. The delivery rate of paste medication 34 can be gradual, thus preventing anxiety or fear in horse 20.

It may be observed that the foregoing specification is not burdened by the inclusion of large amounts of detail and specific information relative to such matters as construction and the like since all such information is well within the skill of the art. It should be noted that the particular embodiment of the invention which is shown and described herein is intended as merely illustrative and not restrictive of the invention. For example, the present invention can be easily adapted for the introduction of feeding formulas to young orphaned animals or other treatment tasks needing oral introduction of paste-like materials. Therefore, the appended claims are intended to cover all modifications to the invention which fall within the scope of the foregoing specification.

I claim as my invention:

1. A device for dispensing paste-like medication onto the tongue of a horse, comprising:

(a) hollow cylindrical tubular means, usable as a bar bit, having an oval orifice on the bottom surface thereof for dispensing said paste-like medication downward onto the tongue of said horse;

(b) rod-shaped plunging means slidably inserted into said tubular means thereby forcing said paste-like medication through said oval orifice onto said horse's tongue; and (c) attachment means for attaching said tubular means to said horse.

2. The device according to claim 1 further comprising removable sealing means to facilitate long-term storage of said device.

3. The device according to claim 1 wherein said plunging means includes means for indicating the volume of medicine dispensed.

4. The device according to claim 1 wherein said tubular means is constructed of recyclable material.

5. The device according to claim 4 wherein said recyclable material is flavored.

6. The device according to claim 1 wherein said attachment means consists of a perforated tab, for attaching twine, at the distal end of said tubular means.

7. A device for dispensing paste-like medication onto the tongue of an animal capable of accepting a bar bit, comprising:

(a) hollow cylindrical tubular means, usable as a bar bit, having an oval orifice on the bottom surface thereof for dispensing said paste-like medication downward onto the tongue of said animal;

(b) rod-shaped plunging means slidably inserted into said tubular means thereby forcing said paste-like medication through said oval orifice onto said animal's tongue; and (c) attachment means for attaching said tubular means to said horse.

8. The device according to claim 7 further comprising removable sealing means to facilitate long-term storage of said device.

9. The device according to claim 7 wherein said plunging means includes means for indicating the volume of medicine dispensed.

10. The device according to claim 7 wherein said tubular means is constructed of recyclable material.

11. The device according to claim 10 wherein said recyclable material is flavored.

12. The device according to claim 7 wherein said attachment means consists of a perforated tab, for attaching twine, at the distal end of said tubular means.

* * * * *